US009039134B2

(12) United States Patent
Ogawa

(10) Patent No.: US 9,039,134 B2
(45) Date of Patent: May 26, 2015

(54) LIQUID EJECTION APPARATUS

(71) Applicant: Mikio Ogawa, Nagoya (JP)

(72) Inventor: Mikio Ogawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/038,611

(22) Filed: Sep. 26, 2013

(65) Prior Publication Data

US 2014/0184689 A1 Jul. 3, 2014

(30) Foreign Application Priority Data

Dec. 28, 2012 (JP) ..... 2012-288992

(51) Int. Cl.
*B41J 2/165* (2006.01)

(52) U.S. Cl.
CPC ..... *B41J 2/16532* (2013.01); *B41J 2/16523* (2013.01)

(58) Field of Classification Search
USPC ..... 347/29–30
See application file for complete search history.

(56) References Cited

U.S. PATENT DOCUMENTS

2008/0309702 A1* 12/2008 Takahashi ..... 347/19

FOREIGN PATENT DOCUMENTS

JP 2010-125746 A 6/2010
JP 2010125746 A * 6/2010

* cited by examiner

*Primary Examiner* — Jason Uhlenhake
(74) *Attorney, Agent, or Firm* — Baker Botts L.L.P.

(57) ABSTRACT

A liquid ejection apparatus of the invention comprises a switcher configured to connect or disconnect a sucker with suction tubes individually. The switcher comprises a case and a rotator. The case comprises an internal space and holes each causing the internal space to communicate with an outside of the case. The rotator is accommodated in the internal space and is rotatable along an inner surface defining the internal space in the case. The suction tubes are respectively connected to the holes. The rotator comprises a passage formed therein. The passage is configured to cause the sucker to communicate with two or more holes without causing the sucker to communicate with the holes other than the two or more holes, depending on a rotational position of the rotator in the internal space.

20 Claims, 15 Drawing Sheets

| PORT | STATUS |
|---|---|
| A | SUCKING |
| B | CLOSED |
| C | CLOSED |
| D | CLOSED |
| E | CLOSED |
| F | CLOSED |

| PORT | STATUS |
|---|---|
| A | OPENED -SUCKING |
| B | PRE-SUCKING |
| C | CLOSED |
| D | CLOSED |
| E | CLOSED |
| F | CLOSED |

| PORT | STATUS |
|---|---|
| A | CLOSED |
| B | SUCKING |
| C | CLOSED |
| D | CLOSED |
| E | CLOSED |
| F | CLOSED |

| PORT | STATUS |
|---|---|
| A | CLOSED |
| B | CLOSED |
| C | CLOSED |
| D | CLOSED |
| E | OPENED -SUCKING |
| F | PRE-SUCKING |

| PORT | STATUS |
|---|---|
| A | CLOSED |
| B | CLOSED |
| C | CLOSED |
| D | CLOSED |
| E | CLOSED |
| F | SUCKING |

| PORT | STATUS |
|---|---|
| A | CLOSED |
| B | CLOSED |
| C | CLOSED |
| D | CLOSED |
| E | CLOSED |
| F | OPENED -SUCKING |

| PORT | STATUS |
|---|---|
| A | CLOSED |
| B | SUCKING |
| C | CLOSED |
| D | CLOSED |
| E | CLOSED |
| F | CLOSED |

| PORT | STATUS |
|---|---|
| A | PRE-SUCKING |
| B | OPENED -SUCKING |
| C | CLOSED |
| D | CLOSED |
| E | CLOSED |
| F | CLOSED |

| PORT | STATUS |
|---|---|
| A | SUCKING |
| B | CLOSED |
| C | CLOSED |
| D | CLOSED |
| E | CLOSED |
| F | CLOSED |

LIQUID EJECTION APPARATUS

CROSS REFERENCE TO RELATED APPLICATION

This application claims priority from Japanese Patent Application No. 2012-288992, which was filed on Dec. 28, 2012, the disclosure of which is herein incorporated by reference in its entirety.

BACKGROUND OF THE INVENTION

1. Field of the Invention

The present invention relates to a liquid ejection apparatus configured to eject liquid.

2. Description of Related Art

There has been known a liquid ejection apparatus including: a plurality of heads each including a plurality of ejection openings; and a plurality of caps configured to close off the ejection openings belonging to the heads from the outside. After the ejection openings of the heads are closed off from the outside by the caps, a single suction pump is connected to the caps in turns to suck ink from the ejection openings. This allows viscous ink in the heads to be discharged to the insides of the caps, thereby recovering ejection performance of ink ejected from the ejection openings. Hereinafter, this is simply referred to as "ejection performance".

SUMMARY OF THE INVENTION

With the above technique, a long period of time is needed to recover the ejection performance since sucking is performed on all the caps in turns.

An object of the present invention is to provide a liquid ejection apparatus capable of shortening the period of time needed to recover the ejection performance.

According to a first aspect of the present invention, there is provided a liquid ejection apparatus comprising a head, a plurality of caps, a mover, a plurality of suction tubes, a sucker, a switcher, and a controller. The head comprises a plurality of ejection opening groups, each ejection opening group comprising one or more ejection openings for ejecting liquid. The caps are provided respectively corresponding to the plurality of ejection opening groups. Each of the caps comprises a recess for forming a closed space opposed to the one or more ejection openings belonging to the corresponding ejection opening group. The mover is configured to move each of the caps relative to the head individually, thereby causing each of the caps to be in either a closed state or an open state. In the closed state, the one or more ejection openings belonging to the corresponding ejection opening group are closed off from an outside. In the open state, the one or more ejection openings belonging to the corresponding ejection opening group are opened to the outside. The suction tubes are respectively connected to the recesses of the caps. The sucker is configured to suck air in the recesses of the caps. The switcher is configured to connect or disconnect the sucker with the suction tubes individually. The controller is configured to control the mover, the sucker, and the switcher. The switcher comprises a case and a rotator. The case comprises an internal space and a plurality of holes. Each of the holes causes the internal space to communicate with an outside of the case. The rotator is accommodated in the internal space. The rotator is rotatable along an inner surface defining the internal space in the case. The suction tubes are respectively connected to the holes. The rotator comprises a passage formed therein. The passage is configured to cause the sucker to communicate with two or more holes out of the plurality of holes without causing the sucker to communicate with the holes other than the two or more holes out of the plurality of holes, depending on a rotational position of the rotator in the internal space.

According to a second aspect of the present invention, there is provided a liquid ejection apparatus comprising a plurality of heads, a plurality of caps, a mover, a plurality of suction tubes, a sucker, a switcher, and a controller. Each of the heads comprises an ejection opening group, the ejection opening group comprising one or more ejection openings for ejecting liquid. The caps are provided respectively corresponding to the plurality of heads. Each of the caps comprises a recess for forming a closed space opposed to the one or more ejection openings belonging to the corresponding ejection opening group. The mover is configured to move each of the caps relative to the heads individually, thereby causing each of the caps to be in either a closed state or an open state. In the closed state, the one or more ejection openings belonging to the corresponding ejection opening group are closed off from an outside. In the open state, the one or more ejection openings belonging to the corresponding ejection opening group are opened to the outside. The suction tubes are respectively connected to the recesses of the caps. The sucker is configured to suck air in the recesses of the caps. The switcher is configured to connect or disconnect the sucker with the suction tubes individually. The controller is configured to control the mover, the sucker, and the switcher. The switcher comprises a case and a rotator. The case comprises an internal space and a plurality of holes. Each of the holes causes the internal space to communicate with an outside of the case. The rotator is accommodated in the internal space. The rotator is rotatable along an inner surface defining the internal space in the case. The suction tubes are respectively connected to the holes. The rotator comprises a passage formed therein. The passage is configured to cause the sucker to communicate with two or more holes out of the plurality of holes without causing the sucker to communicate with the holes other than the two or more holes out of the plurality of holes, depending on a rotational position of the rotator in the internal space.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes preferred embodiments of the present invention, with reference to the drawings.

First Embodiment

First, description will be given for an ink jet printer 1 of a first embodiment of the present invention.

Figure 1A:
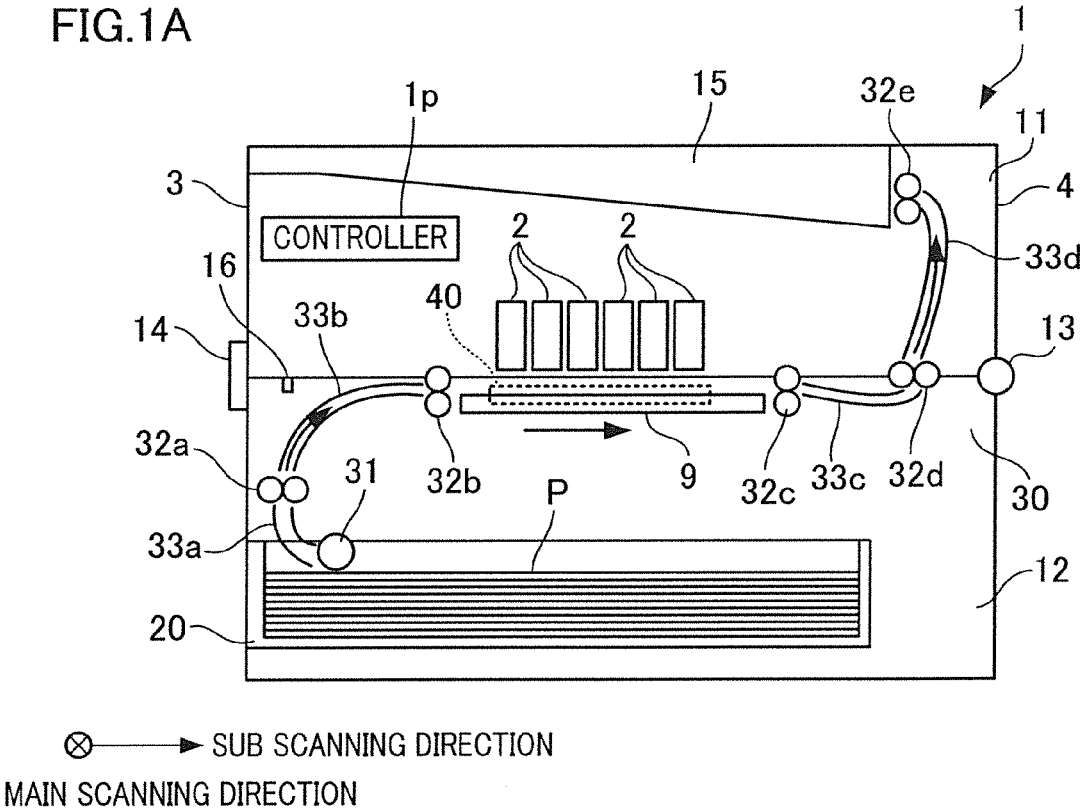
FIG. 1A is a schematic side view showing the inside of an ink jet printer of a first embodiment of the present invention.

As shown in FIG. 1A, the printer 1 includes an upper case 11 and a lower case 12. Each of the cases 11 and 12 has a rectangular parallelepiped shape. A left side surface in FIG. 1A is a front surface 3 of the entire case constituted by the upper case 11 and the lower case 12, whereas a right side surface in FIG. 1A is a back surface 4 of the entire case. The upper case 11 has an open bottom, and the lower case 12 has an open top. The upper case 11 is coupled to the lower case 12 so as to be rotatable about a rotation axis 13. The rotatability allows the upper case 11 to take two positions of: a closed position in which the internal space of the printer 1 is closed; and an open position in which the internal space of the printer 1 is opened. An opening/closing sensor 16 is provided on an upper portion of the lower case 12. The opening/closing sensor 16 outputs a detection signal when the upper case 11 is in the closed position, and the sensor 16 does not output the detection signal when the upper case 11 is in the open position. The printer 1 includes a locking mechanism 14 which prevents the rotation of the upper case 11 when the upper case 11 is in the closed position. A discharged paper receiver 15 is provided on a top surface of the upper case 11. To the discharged paper receiver 15, sheets P on which printing has been completed are discharged in order.

In the internal space of the printer 1, there are arranged: six ink jet heads 2; a tray 20; a conveyor mechanism 30; a platen 9; and a maintenance unit 40.

Figure 1B:
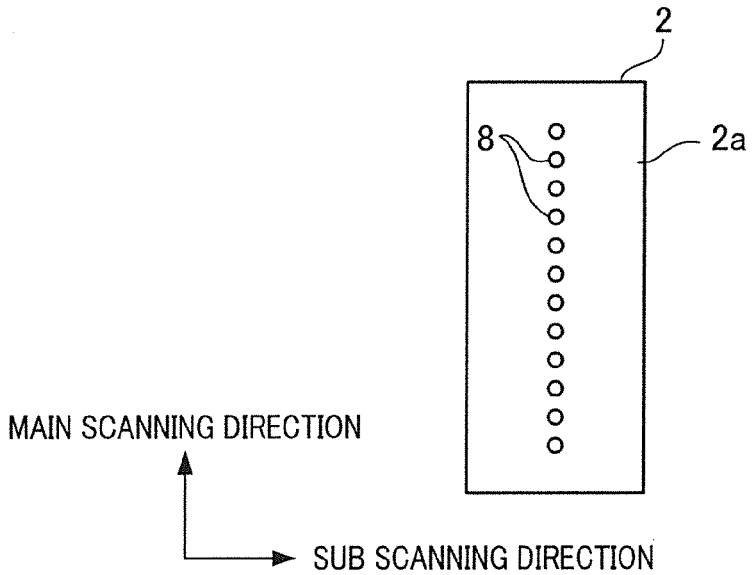
FIG. 1B is a plan view of a head included in the printer shown in FIG. 1A.

As shown in FIG. 1B, each of the heads 2 has a substantially rectangular parallelepiped shape. An under surface of each head 2 is an ejection surface 2*a*. On the ejection surface 2*a*, there are formed a plurality of ejection openings 8 for ejecting ink. Ink supplied to each head 2 from a corresponding ink tank (not shown) passes through a common ink chamber and a plurality of pressure chambers, and then reaches the ejection openings 8. Each head 2 includes actuators (not shown) each applying pressure to ink in the corresponding pressure chamber. By driving the actuator, ink is ejected from the ejection opening 8 associated therewith.

The six heads 2 eject ink as follows: the head located most upstream in a conveyance direction of a sheet P ejects yellow ink, and the following heads respectively eject light cyan, light magenta, cyan, magenta, and black inks, in this order. In this embodiment, the heads 2 respectively eject different types of ink. However, two or more heads 2 may eject the same type of ink, or a single head 2 may eject different types of ink.

The tray 20 is capable of holding a plurality of sheets P stacked thereon. The tray 20 is attachable to/detachable from the lower case 12, and is disposed at the bottom of the case 12.

The platen 9 is a plate for supporting a sheet. The platen 9 is fixed to the lower case 12, and is positioned so as to be opposed to the ejection surfaces 2*a* when the upper case 11 is in the closed position. The size of the platen 9 is slightly larger than the total size of the six ejection surfaces 2*a*, with respect to a main scanning direction and a sub scanning direction.

The conveyor mechanism 30 forms a conveyance path for a sheet P, the conveyance path extending from the tray 20 to the discharged paper receiver 15 via a space between the six heads 2 and the platen 9. The conveyor mechanism 30 includes a pickup roller 31, pairs of nip rollers 32*a* to 32*e*, and guides 33*a* to 33*d*. The pickup roller 31 rotates while being in contact with an uppermost sheet P of the sheets P in the tray 20, thereby forwarding the sheet P. The pairs of nip rollers 32*a* to 32*e* are spaced apart from each other along the conveyance path. Each of the pairs of nip rollers 32*a* to 32*e* rotate while gripping a sheet P, thereby applying a conveyance force to the sheet P. The guides 33*a* to 33*d* are disposed, along the conveyance path, in the space between the pickup roller 31 and the pair of rollers 32*a* and the spaces between the pairs of nip rollers 32*a* to 32*e*, respectively. Each of the guides 33*a* to 33*d* guides a sheet P to which the conveyance force has been applied by the corresponding one of the pairs of nip rollers 32*a* to 32*e* until the sheet P reaches the next pair of nip rollers. A sheet P conveyed by the conveyor mechanism 30 is printed with ink ejected from the ejection openings 8 of the heads 2 when the sheet P passes between the six heads 2 and the platen 9. The printed sheet P is conveyed further by the conveyor mechanism 30, to be discharged to the discharged paper receiver 15.

Figure 2:
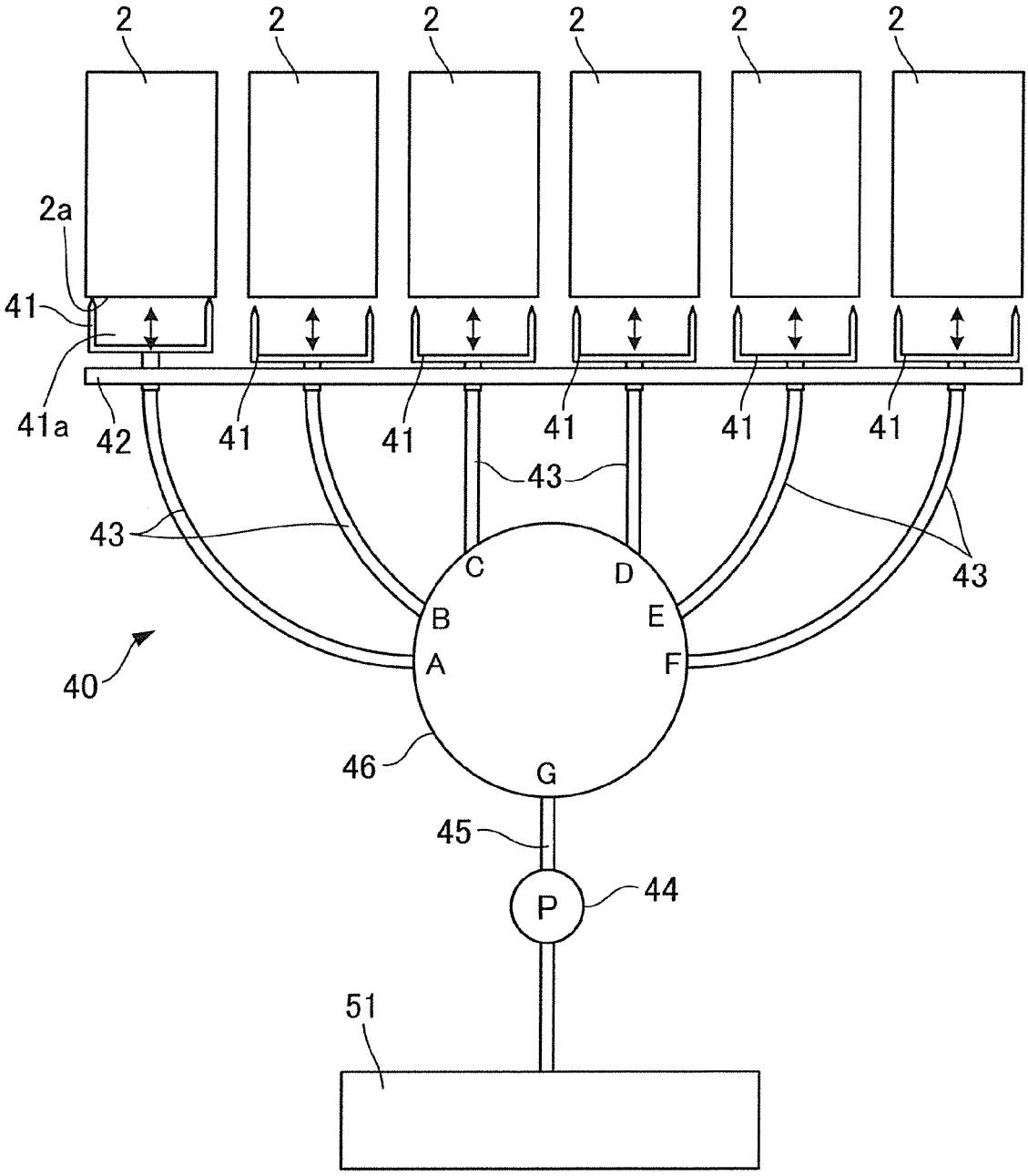
FIG. 2 is a schematic diagram of a maintenance unit of the printer shown in FIG. 1A.

As shown in FIGS. 1A, 1B, and 2, the maintenance unit 40 performs a maintenance operation. The maintenance operation is an operation for solving or preventing clogging problems in the ejection openings 8, and it includes purging, flushing, and capping. Purging is an operation in which ink is forced to be discharged from the ejection openings 8. Flushing is an operation in which ink is ejected from the ejection openings 8 based on flushing data different from printing data. Capping is an operation in which the ejection surfaces 2*a* are covered with caps 41, thereby to close off all the ejection openings 8 formed on the ejection surfaces 2*a* from the outside. Capping prevents the ejection openings 8 from drying. The maintenance unit 40 includes six caps 41, a lifting and lowering mechanism 42, six suction tubes 43, a pump 44, a waste tube 45, a rotary valve 46, and a waste tank 51.

Each of the caps 41 is configured to be able to take (i) a closed state in which all the ejection openings 8 of the corresponding head 2 are closed off from the outside; and (ii) an open state in which the ejection openings 8 are opened to the outside. In FIG. 2, the closed state is illustrated with the leftmost cap 41, and the open state is illustrated with the caps 41 other than the leftmost cap 41. Each cap 41 is made of an elastic material, and each cap 41 includes a recess 41*a* and an annular protrusion defining the recess 41*a*. The recess 41*a* has an open top, and it is capable of covering the substantially entire ejection surface 2*a* corresponding thereto. Each cap 41 is in the closed state when a distal end of its protrusion is in contact with the corresponding ejection surface 2*a*, and each cap 41 is in the open state when the distal end is separated from the ejection surface 2*a*.

The lifting and lowering mechanism 42 holds the six caps 41 with the caps 41 aligned in one direction. Although detailed description is omitted here, the lifting and lowering mechanism 42 lifts/lowers each cap 41 individually so that each cap 41 takes the closed state or the open state independently. That is, the lifting and lowering mechanism 42 corresponds to a mover of the present invention.

The maintenance unit 40 is in a withdrawal position when the printer 1 is on standby. The withdrawal position is the position where the maintenance unit 40 is not opposed to the ejection surfaces 2*a*. In other words, it is a position farther from a viewer than the platen 9 in FIG. 1A. When the maintenance operation is performed, a controller 1*p* controls a moving mechanism (not shown), and thereby the maintenance unit 40 is moved to a maintenance position from the withdrawal position. The maintenance position is the position where the recesses 41*a* of the caps 41 are respectively opposed to the ejection surfaces 2*a* of the heads 2.

The rotary valve 46 causes one or two cap(s) 41 out of the six caps 41 to communicate with the pump 44. The waste tank 51 stores waste ink. The waste ink is produced by purging and flushing. The six suction tubes 43 connect the recesses 41*a* of the corresponding caps 41 with the rotary valve 46. The waste tube 45 connects the rotary valve 46 with the waste tank 51. The pump 44 is connected to the waste tube 45. The pump 44 is an element for generating a suction force, and is configured to suck air in the recesses 41*a*. That is, the pump 44 corresponds to a sucker of the present invention.

Figure 3:
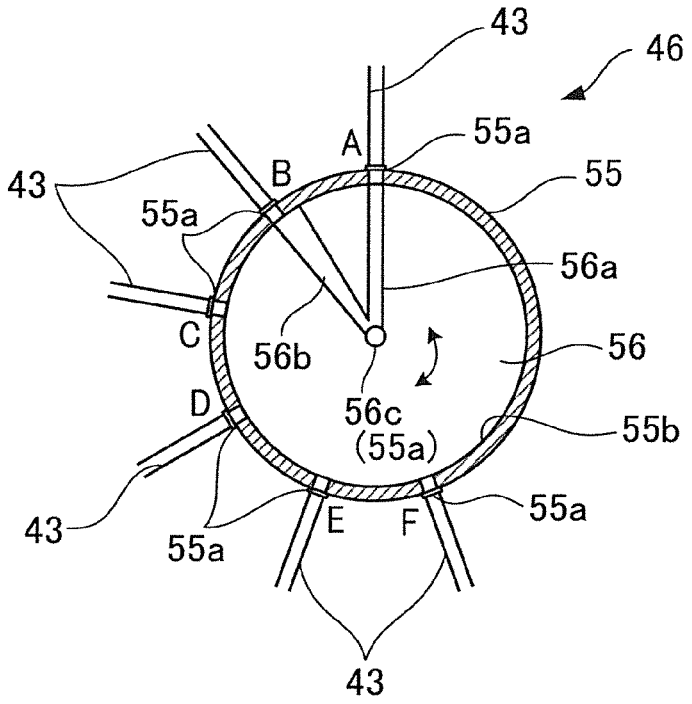
FIG. 3 is a schematic sectional view of a rotary valve of the maintenance unit shown in FIG. 2.

The rotary valve 46 will be described with reference to FIGS. 2 and 3. The rotary valve 46 includes a case 55, and a rotator 56 accommodated in an internal space 55*b* of the case 55. The case 55 has a cylindrical shape. The rotator 56 has a columnar shape. The rotator 56 is rotatable in the internal space 55*b*, along an inner surface defining the internal space 55*b* in the case 55. The case 55 includes seven holes 55*a* formed therethrough, each of which causes the internal space 55*b* to communicate with the outside of the case 55. Out of the seven holes 55*a*, six holes 55*a* arranged in a circumferential direction of the rotator 56 are ports A to F. The six holes 55*a* includes three pairs of holes, each of which pairs is constituted by two holes 55*a* adjacent to each other in the circumferential direction of the rotator 56. Specifically, there are a pair corresponding to the ports A and B, a pair corresponding to the ports C and D, and a pair corresponding to the ports E and F. In each pair, the two holes 55*a* are spaced apart from each other in the circumferential direction of the rotator 56 at a same angle with respect to a rotation center of the rotator 56. Out of the seven holes 55*a*, the hole 55*a* formed at a center of an end surface of the case 55 is a port G. The ports A to F are respectively connected with the suction tubes 43, and the port G is connected with the waste tube 45.

In the rotator 56, there are formed: a first passage 56*a* and a second passage 56*b* each of which extends from an outer peripheral surface of the rotator 56 to a rotation axis of the rotator 56 in a radial direction of the rotator 56; and a third passage 56*c* which extends along the rotation axis and connects the first and second passages 56*a* and 56*b* with the port G. The length of the second passage 56*b* in the circumferential direction of the rotator 56, that is, the width thereof increases toward the outer peripheral surface of the rotator 56. Therefore, the cross section of the first passage 56*a* is smaller than the cross section of the second passage 56*b*. The first passage 56*a* and the second passage 56*b* are configured so that, as the rotator 56 rotates in one direction, first, one of the passages communicates with one of two ports belonging to one pair of holes selected from the three pairs of holes, then, both of the passages respectively communicate with both of the two ports, and finally the other passage communicates with the other one of the two ports. The first passage 56*a* is connected to the port (A to F) corresponding to the open-state cap 41. The second passage 56*b* is connected to the port (A to F) corresponding the closed-state cap 41. Thus, the caps 41 corresponding the ports (A to F) to which the first and second passages 56*a* and 56*b* are connected are connected to the port G. The port G is connected to the pump 44. The rotational position of the rotator 56 is controlled by a not-shown motor.

Figure 4:
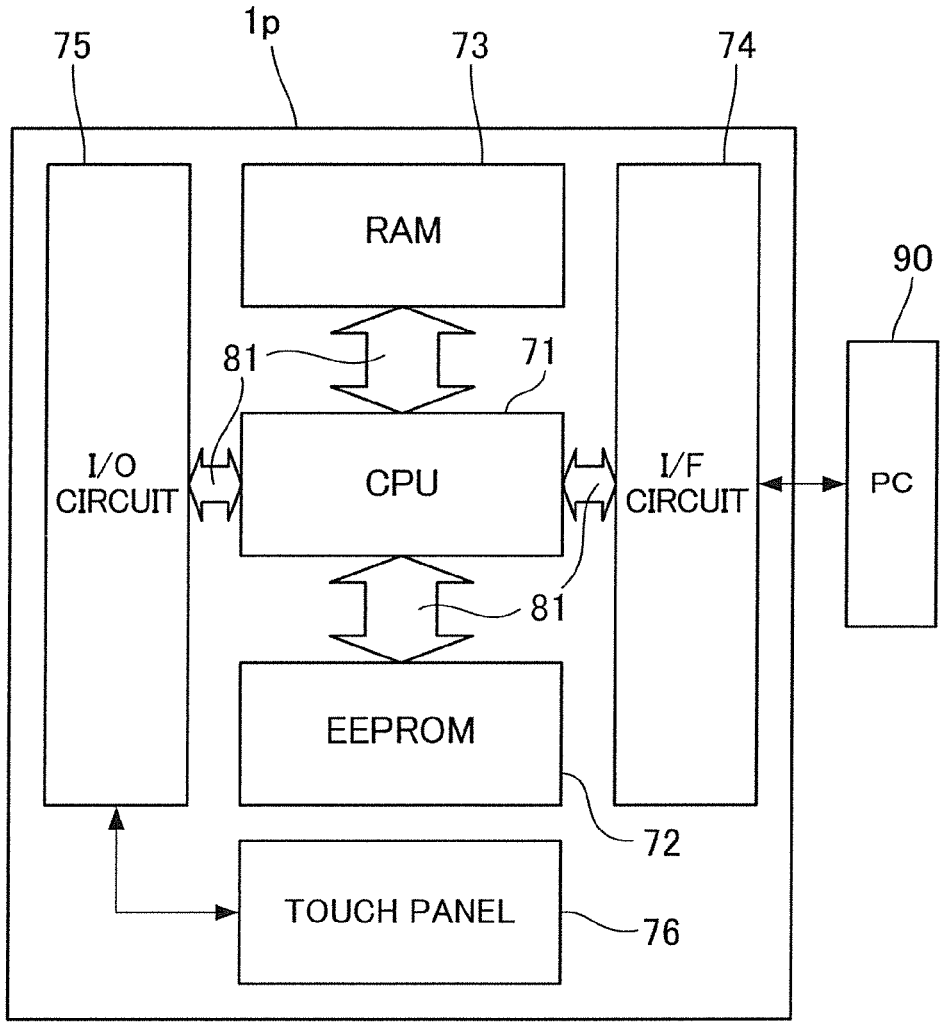
FIG. 4 is a diagram showing a hardware configuration of a controller of the printer shown in FIG. 1A.

Next, description will be given for the controller 1*p* which controls the printer 1. As shown in FIG. 4, the controller 1*p* includes: a CPU (Central Processing Unit) 71; an EEPROM (Electrically Erasable and Programmable Read Only Memory) 72 which rewritably stores programs executed by the CPU and data used in these programs; a RAM (Random Access Memory) 73 which temporarily stores data at the time of executing a program; an I/F circuit 74 which communicates with an external device such as a PC 90; and an I/O circuit 75 connected to a touch panel 76 and various sensors (not shown). These are connected with each other through data buses 81. Each of function units of the controller 1*p*, which will be described later, is constructed by the hardware and software stored in the EEPROM, which hardware and software cooperate with each other.

Figure 5:
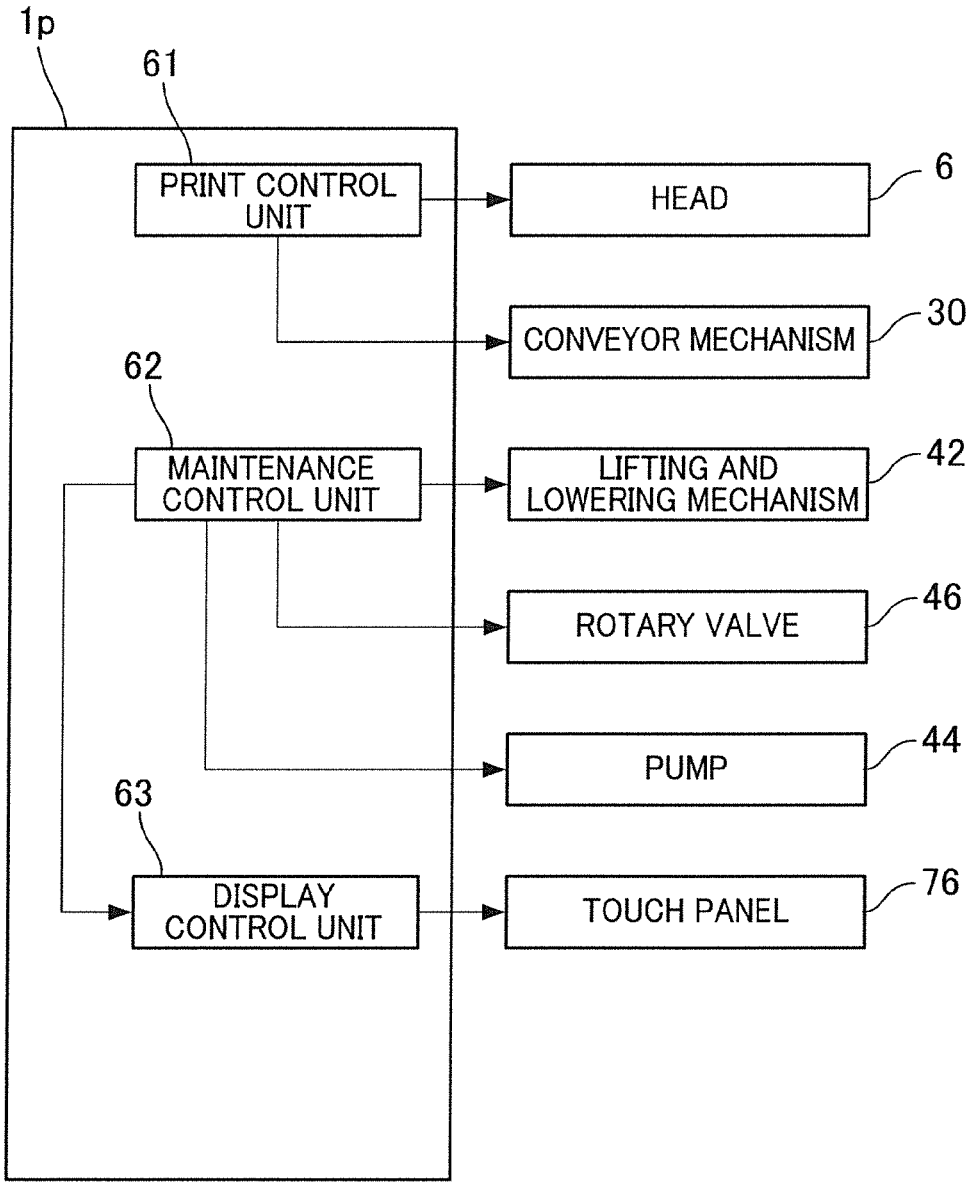
FIG. 5 is a functional block diagram of the controller of the printer shown in FIG. 1A.

Further, as shown in FIG. 5, the controller 1*p* includes a print control unit 61, a maintenance control unit 62, and a display control unit 63. The print control unit 71 controls the operation of the heads 2 and the conveyor mechanism 30 so that a desired image is printed on a sheet P. The display control unit 63 controls the touch panel 76. The maintenance control unit 62 controls the lifting and lowering mechanism 42, the rotary valve 46, and the pump 44 so that the maintenance operation is performed. Purging includes a sucking operation, an opened-sucking operation, and a pre-sucking operation. The sucking operation is an operation for sucking air in the recess 41*a* of a closed-state cap 41. The opened-sucking operation is an operation for sucking air in the recess 41*a* of an open-state cap 41. The pre-sucking operation is an operation performed simultaneously with the opened-sucking operation, for sucking air in the recess 41*a* of another closed-state cap 41.

Figure 6:
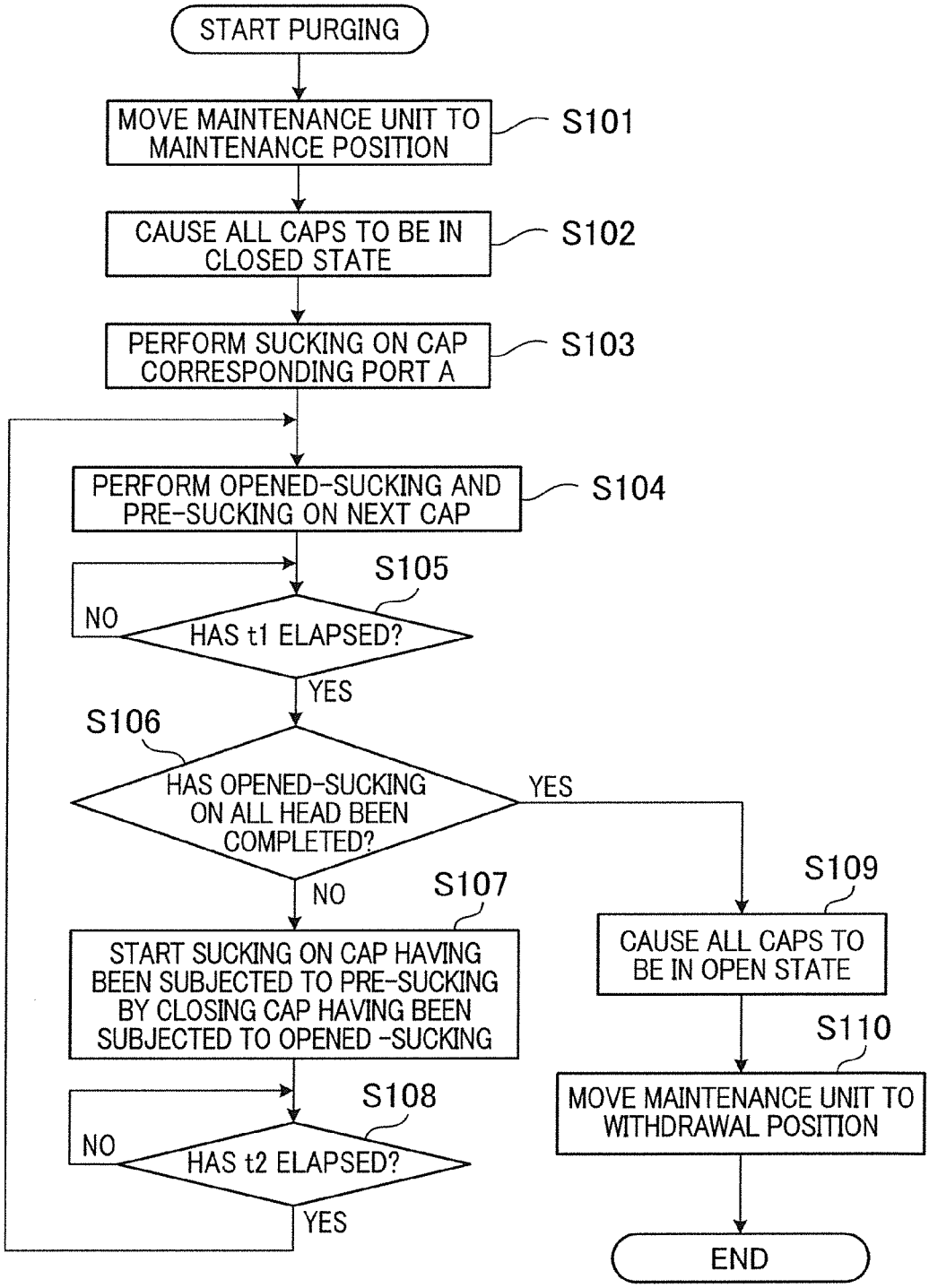
FIG. 6 is a flowchart related to a maintenance operation of the printer shown in FIG. 1A.

The following describes the control made by the maintenance control unit 62 for purging, with reference to FIGS. 6 to 9. As shown in FIG. 6, at the beginning of purging, the maintenance control unit 62 first moves the maintenance unit 40 to the maintenance position (S101), thereby causing the recesses 41*a* of the caps 41 to be respectively opposed to the ejection surfaces 2*a* of the heads 2. Further, the maintenance control unit 62 controls the lifting and lowering mechanism 42 so that all the caps 41 are in the closed state, that is, capping is performed on all the caps 41 (S102). Then, in order to perform the sucking operation on the head 2 corresponding the port A, the maintenance control unit 62 rotates the rotator 56 to connect the port A with the second passage 56*b*, as shown in FIG. 7A. This allows the recess 41*a* of the closed-state cap 41 corresponding to the port A to communicate with the pump 44. By driving the pump 44 in this state for a predetermined period of time, the sucking operation is performed, and ink is ejected to the recess 41*a* from the ejection openings 8 opposed to the recess 41*a* (S103).

Figure 7A:
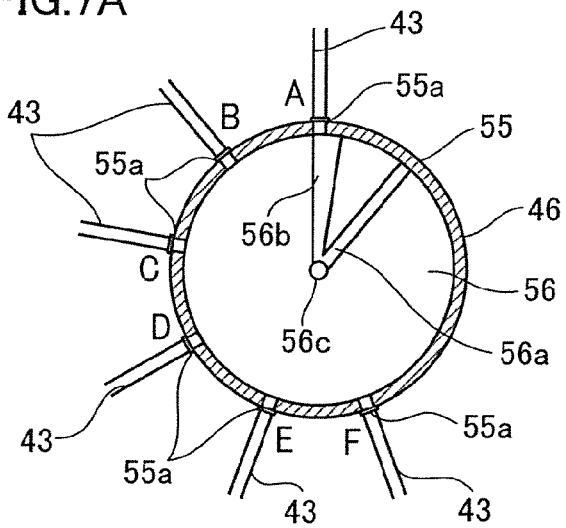
FIGS. 7A, 7B, and 7C are diagrams for describing the operation of the maintenance unit of the printer shown in FIG. 1A.
Figure 7B:
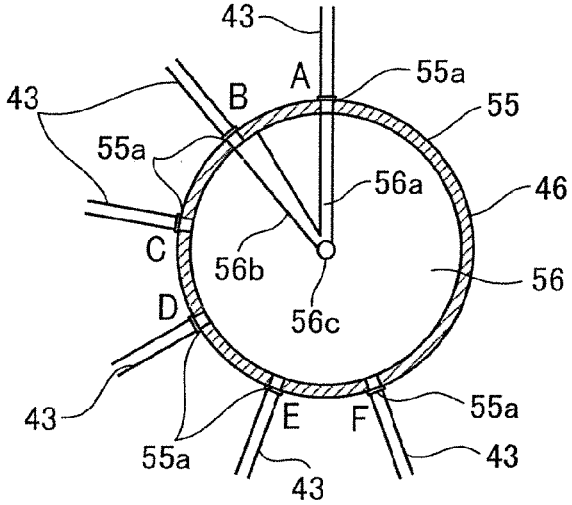

Then, the maintenance control unit 62 performs the following operations simultaneously: the opened-sucking operation in which the cap 41 corresponding the head 2 on which the sucking operation has been just finished is brought into the open state and ink stored in its recess 41*a* is sucked; and the pre-sucking operation in which the cap 41 corresponding the next head 2 on which the sucking operation will be performed is brought into the closed state and air in its recess 41*a* is sucked in advance (S104). Specifically, the maintenance control unit 62 controls the lifting and lowering mechanism 42, to cause the cap 41 corresponding to the port A to transition from the closed state to the open state and to maintain the cap 41 corresponding the port B in the closed state. Further, the maintenance control unit 62 controls the rotary valve 46, to rotate the rotator 56 in a counterclockwise direction as shown in FIG. 7B, thereby connecting the port A with the first passage 56*a* and connecting the port B with the second passage 56*b*. Hereinafter, this state is referred to as a first connection state. As a result, the recesses 41*a* of the two caps 41 corresponding to the ports A and B communicate with the driven pump 44, and the opened-sucking operation is performed on the recess 41*a* of the open-state cap 41 corresponding the port A, while the pre-sucking operation is performed on the recess 41*a* of the closed-state cap 41 corresponding to the port B.

Figure 9:
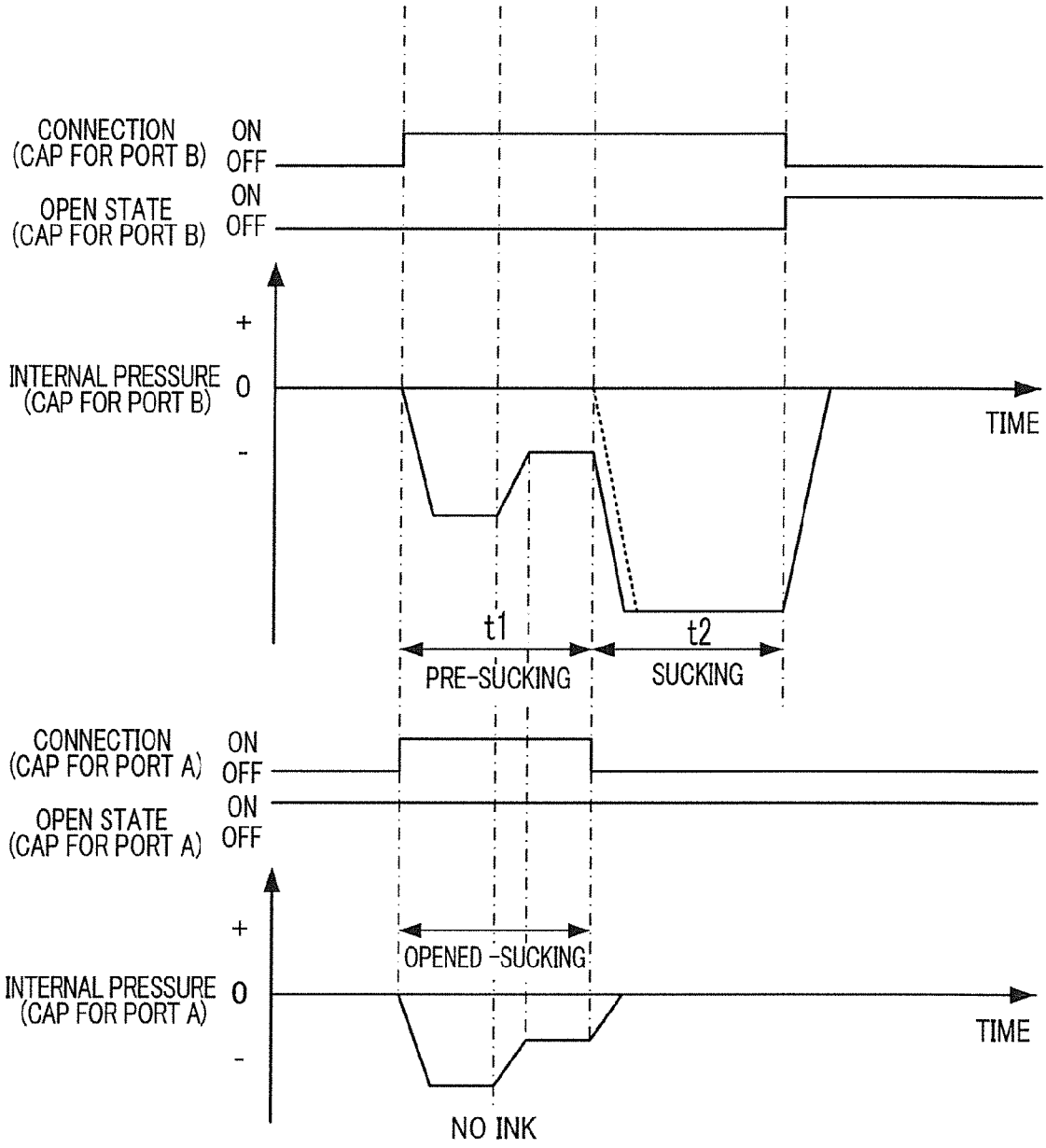
FIG. 9 is a timing chart showing the operation of the maintenance unit of the printer shown in FIG. 1A.

The maintenance control unit 62 waits until an elapsed time from the start of the opened-sucking operation reaches a time t1 (S105: NO). The time t1 is a period of time equal to or longer than the period of time required to completely suck the maximum amount of ink storable in the recess 41*a*, which is an object of the opened-sucking operation. This ensures that ink remaining in the recess 41*a* is discharged. As shown in FIG. 9, when ink remaining in the recess 41*a* corresponding to the port A is sucked through the opened-sucking operation, the internal pressure in each of the recesses 41*a* corresponding to the ports A and B is reduced. Then, after the ink remaining in the recess 41*a* corresponding to the port A has been completely sucked, the port A is exposed to the atmosphere, and the internal pressure in each of the recesses 41*a* corresponding to the ports A and B is increased. However, since the pump 44 is still driven, some level of negative pressure is maintained in each of the recesses 41*a* corresponding to the ports A and B.

When the maintenance control unit 62 determines that the elapsed time has reached the time t1 (S105: YES), the maintenance control unit 62 determines whether the opened-sucking operation has been completed on all the heads 2 (S106). When the maintenance control unit 62 determines that the opened-sucking operation has been completed on all the heads 2 (S106: YES), the maintenance control unit 62 causes all the caps 41 to be in the open state (S109). Then, the maintenance control unit 62 moves the maintenance unit 40 to the withdrawal position. Thereafter, the maintenance control unit 62 ends the routine of FIG. 6 (S110).

Figure 7C:
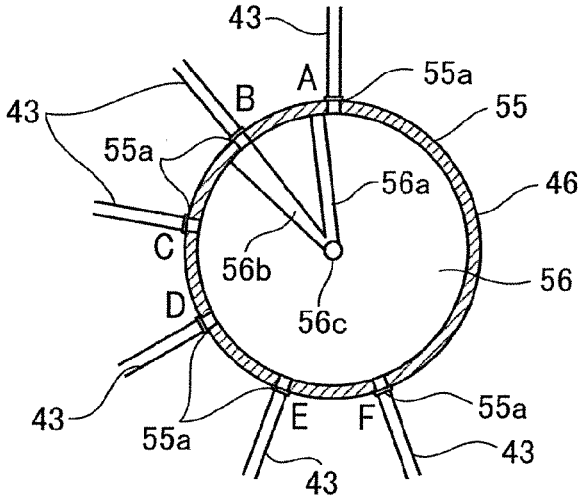

When the maintenance control unit 62 determines that the opened-sucking operation has not been completed on all the heads 2 (S106: NO), the maintenance control unit 62 performs purging on the next head 2 (S107). In S107, the maintenance control unit 62 controls the rotary valve 46 to rotate the rotator 56 in the counterclockwise direction, thereby establishing a state in which: the port A is closed; and the connection between the port B and the second passage 56*b* is maintained, as shown in FIG. 7C. Hereinafter, this state is referred to as a second connection state. With this, the cap 41 corresponding to the port A transitions from the open state to the closed state, while the cap 41 corresponding to the port B is maintained in the closed state. At this time, in the closed-state cap 41 corresponding to the port B, its recess 41*a* communicates with the driven pump 44, and the sucking operation is started, so that ink is discharged from the ejection openings 8 opposed to the recess 41*a*. Here, as shown in FIG. 9, the negative pressure created by the pre-sucking operation performed prior thereto is maintained in the recess 41*a* corresponding the port B, and therefore the pressure therein is quickly decreased to a desired level compared with a case where the pre-sucking operation is not performed (see a broken line in FIG. 9). Therefore, ink is efficiently discharged from the ejection openings 8 opposed to the recess 41*a*. Then, the maintenance control unit 62 waits until an elapsed time from the start of the sucking operation reaches a time t2 (S108: NO). The time t2 corresponds to a period of time required to recover the ejection performance by purging.

Figure 8A:
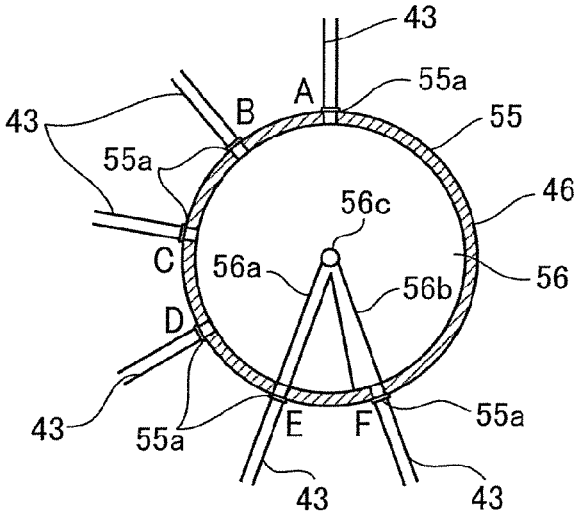
FIGS. 8A, 8B, and 8C are diagrams for describing the operation of the maintenance unit of the printer shown in FIG. 1A.
Figure 8B:
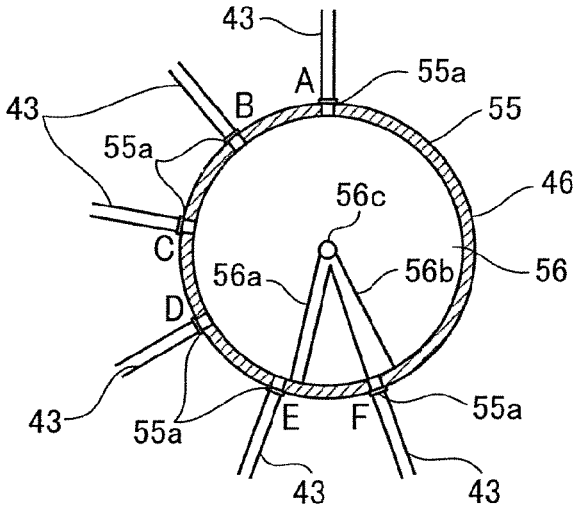
Figure 8C:
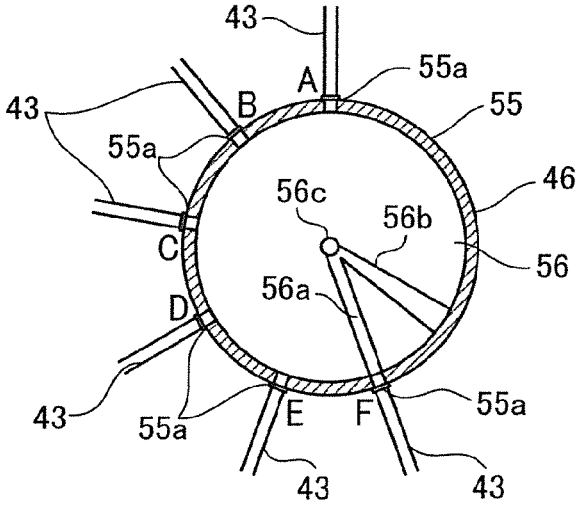

When the maintenance control unit 62 determines that the elapsed time has reached the time t2 (S108: YES), the maintenance control unit 62 simultaneously performs the following operations in the above-described manner: the opened-sucking operation on the recess 41*a* on which the sucking operation has been already performed; and the pre-sucking operation on the recess 41*a* corresponding the next head 2 on which purging should be performed, if any. This process is performed in the same way on the ports B and C, the ports C and D, the ports D and E, and the ports E and F (see FIGS. 8A and 8B). Thus, the pre-sucking operation, the sucking operation, and the opened-sucking operation are sequentially performed on each head 2. For the head 2 corresponding to the port F, the opened-sucking operation is performed solely as shown in FIG. 8C (S104). When the opened-sucking operation is completed on the head 2 corresponding to the port F, the maintenance control unit 62 determines that the opened-sucking operation has been completed on all the heads 2 (S106: YES), and the maintenance control unit 62 causes all the caps 41 to be in the open state (S109). Then, the maintenance control unit 62 moves the maintenance unit 40 to the withdrawal position. Thereafter, the maintenance control unit 62 ends the routine of FIG. 6 (S110).

Thus, the first connection state makes it possible to perform the pre-sucking operation by which a negative pressure is created in the recess 41*a* of the cap 41 to be subjected to the sucking operation, simultaneously with the opened-sucking operation. While the recess 41*a* is under the negative pressure, the operation is changed from the pre-sucking operation to the sucking operation, and therefore, the pressure in the recess 41*a* subjected to the sucking operation is quickly decreased to a predetermined negative pressure level, compared with the case where the negative pressure is not created in the recess 41*a* before the sucking operation. This allows ink to be efficiently discharged from the ejection openings 8, and shortens the period of time required to recover the ejection performance.

In this embodiment, the opened-sucking operation and the pre-sucking operation are respectively and simultaneously performed on the two caps 41 corresponding to two ports (A to F) adjacent to each other. However, the present invention is not limited thereto. For example, the sucking operation may be simultaneously performed on the two caps 41 corresponding to two ports (A to F) adjacent to each other, with the two caps 41 in the closed state, while causing only the two ports (A to F) adjacent to each other to communicate with the pump 44 without causing the other ports (A to F) to communicate with the pump 44.

As described above, in this embodiment, the recesses 41*a* of two caps 41 are connected to the pump 44 as a result of selection of a rotational position of the rotator 56, and therefore, it is possible to suck air in the recesses 41*a* of the two caps 41 at the same time. This shortens the period of time required to recover the ejection performance. Consequently, the maintenance operation is completed quickly.

With the rotation of the rotator 56, every port (A to F) communicates with the pump 44 at least once. Therefore, the sucking is performed on all the caps 41 efficiently.

Each cap 41 is individually brought into the closed state or the open state. Therefore, various maintenance operations are possible including the sucking operation, the opened-sucking operation, and the like.

Each cap 41 regarding which air in the recess 41*a* is not sucked is always in the closed state. This prevents the corresponding ejection openings 8 from drying.

Second Embodiment

The following describes a second embodiment of the present invention with reference to FIGS. 10A, 10B, 11A, 11B, and 11C. The second embodiment is different from the first embodiment in the rotary valve. Hereinafter, the structure and the operation of the rotary valve will be described. Components other than the rotary valve will be given the same reference numerals as in the first embodiment, and the description thereof will be omitted.

A rotary valve 146 of the second embodiment includes: the case 55; and the rotator 56 accommodated in the internal space 55*b* of the case 55. The case 55 has a cylindrical shape. The rotator 56 has a columnar shape. The rotator 56 is rotatable in the internal space 55*b*, along the inner surface defining the internal space 55*b* in the case 55. The case 55 includes seven holes 55*a* formed thereon, each of which causes the internal space 55*b* to communicate with the outside of the case 55. Out of the seven holes 55*a*, six holes 55*a* which are spaced apart from each other in the circumferential direction of the rotator 56 at intervals of 60 degree central angle with respect to the rotation center of the rotator 56, are the ports A to F. Out of the seven holes 55*a*, the hole 55*a* formed at the center of the end surface of the case 55 is the port G. The ports A to F are respectively connected with the suction tubes 43, and the port G is connected with the waste tube 45.

In the rotator 56, there are formed: six selection passages 156*aa*, 156*ab*, 156*ba*, 156*bb*, 156*ca*, and 156*cb* each extending in the radial direction of the rotator 56 from the outer peripheral surface of the rotator 56 to the rotation axis of the rotator 56; and a suction passage 156*d* extending along the rotation axis and connecting the selection passages 156*aa*, 156*ab*, 156*ba*, 156*bb*, 156*ca*, and 156*cb* with the port G. The selection passages 156*aa* and 156*ab* constitute a selection passage pair 157*a*. The selection passages 156*ba* and 156*bb* constitute a selection passage pair 157*b*. The selection passages 156*ca* and 156*cb* constitute a selection passage pair 157*c*. The selection passages 156*aa* and 156*ab* are spaced apart from each other in the circumferential direction of the rotator 56 at the central angle of 60 degrees (X). The selection passages 156*ba* and 156*bb* are spaced apart from each other in the circumferential direction of the rotator 56 at a central angle of 120 degrees (X*2). The selection passages 156*ca* and 156*cb* are spaced apart from each other in the circumferential direction of the rotator 56 at a central angle of 180 degrees (X*3). The length of each selection passage in the circumferential direction of the rotator 56, that is, the width thereof increases toward the outer peripheral surface of the rotator 56. In other words, each selection passage widens, toward the outer peripheral surface of the rotator 56, in a direction apart from the paired selection passage. Two selection passages respectively belonging to different selection passage pairs (157*a* to 157*c*) are spaced apart from each other in the circumferential direction of the rotator 56 at a central angle other than 60 degrees.

The pairs of selection passages 156*aa* and 156*ab*, 156*ba* and 156*bb*, and 156*ca* and 156*cb* are configured so that, as the rotator 56 rotates in one direction, one of the selection passages of one pair first communicate with one of two ports selected from the ports A to F, then both of these selection passages respectively communicate with both of the two ports, and finally the other one of these selection passages communicates with the other one of the two ports. The ports A to F are arranged at equal intervals of the 60 degree central angle. Therefore, any two ports selected from the ports A to F are spaced apart from each other at the central angle of 60 degrees, 120 degrees, or 180 degrees. Therefore, the two ports are connected to each other by one of the three selection passage pairs 157*a* to 157*c*. Two selection passages respectively belonging to different selection passage pairs (157*a* to 157*c*) are spaced apart from each other in the circumferential direction of the rotator 56 at a central angle other than 60 degrees. Accordingly, there is no chance that the ports which are not selected (i.e., the ports other than the selected two ports) are connected to the selection passages of the selection passage pairs other than the selected selection passage pair.

Figure 10A:
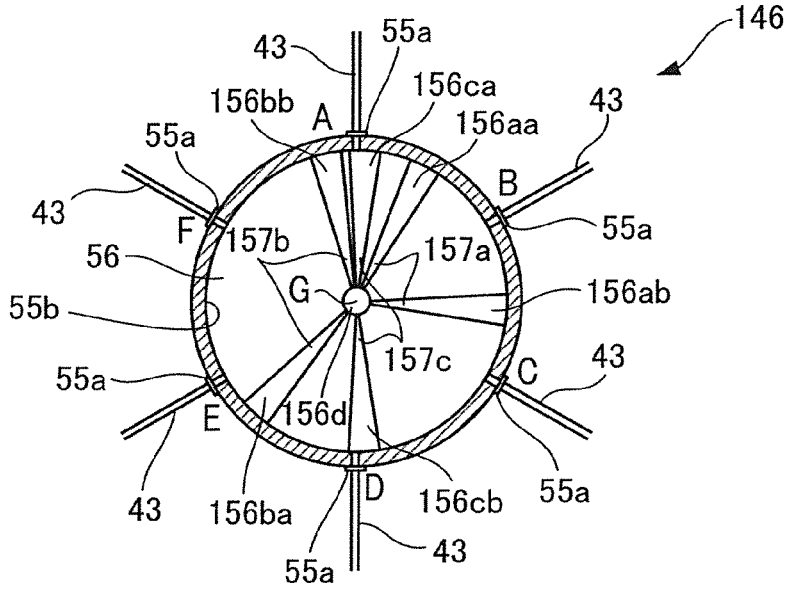
FIGS. 10A and 10B are schematic sectional views each showing the rotary valve of the ink jet printer of a second embodiment of the present invention.
Figure 10B:
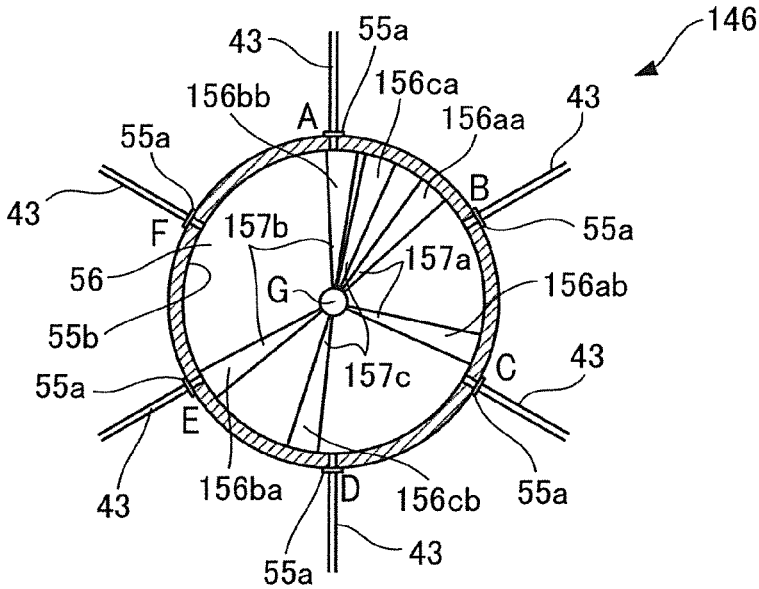
Figure 11A:
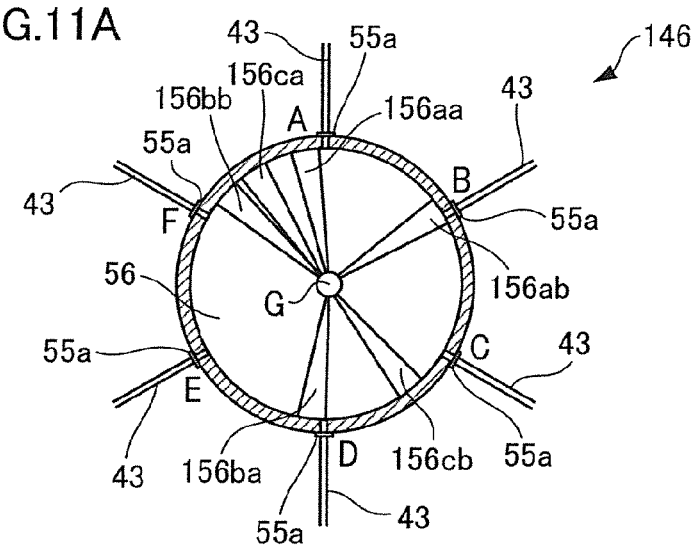
FIGS. 11A, 11B, and 11C are diagrams for describing the operation of the rotary valve shown in FIGS. 10A and 10B.
Figure 11B:
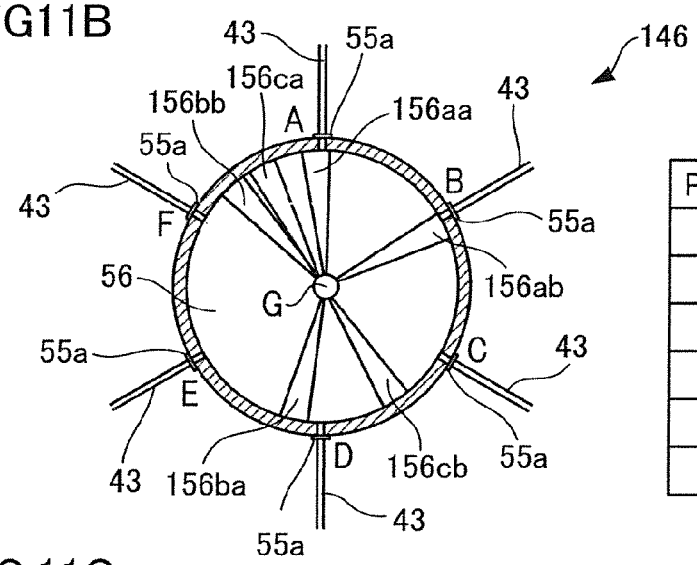

For example, as shown in FIG. 10A, when it is desired that the ports A and D spaced apart from each other at the central angle of 180 degrees communicate with the pump 44, the selection passages 156*ca* and 156*cb* which belong to the selection passage pair 157*c* and are spaced apart from each other at the central angle of 180 degrees are respectively connected to the ports A and D. In FIG. 10A, the selection passage 156*ca* is connected to the port A, and the selection passage 156*cb* is connected to the port D. As shown in FIG. 10B, when it is desired that the ports A and E spaced apart from each other at the central angle 120 degrees communicate with the pump 44, the selection passages 156*ba* and 156*bb* which belong to the selection passage pair 157*b* and are spaced apart from each other at the central angle of 120 degrees are respectively connected to the ports A and E. In FIG. 10B, the selection passage 156*bb* is connected to the port A, and the selection passage 156*ba* is connected to the port E. When it is desired that the ports A and B spaced apart from each other at the central angle of 60 degrees communicate with the pump 44, the selection passages 156*aa* and 156*ab* which belong to the selection passage pair 157*a* and are spaced apart from each other at the central angle of 60 degrees are respectively connected to the ports A and B. In FIG. 11B, the selection passage 156*aa* is connected to the port A, and the selection passage 156*ab* is connected to the port B.

Purging is performed on each pair of two heads 2 arbitrarily selected. For example, when the two heads 2 selected as an object of purging correspond to the ports A and B, the maintenance control unit controls the lifting and lowering mechanism 42, to cause the cap 41 corresponding to the port B to be in the closed state. Then, the maintenance control unit controls the rotary valve 56, to rotate the rotator 56, thereby connecting the selection passage 156*ab* to the port B, as shown in FIG. 11A. At this time, the selection passage 156*aa* is in a position such that the selection passage 156*aa* is immediately before the port A supposing that the rotator 56 rotates in the clockwise direction. With this, the port B communicates with the pump 44, and the other ports A and C to F are closed. The recess 41*a* of the closed-state cap 41 corresponding to the port B communicates with the pump 44. By driving the pump 44 in this state for a predetermined period of time, the sucking operation is performed, and ink is discharged to the recess 41*a* from the ejection openings 8 opposed to the recess 41*a*.

The maintenance control unit controls the lifting and lowering mechanism 42, to cause the cap 41 corresponding the port B to transition from the closed state to the open state and to cause the cap 41 corresponding to the port A to be in the closed state. Then, the maintenance control unit controls the rotary valve 56 to rotate the rotator 56 in the clockwise direction, thereby connecting the port A to the selection passage 156*aa* and connecting the port B to the selection passage 156*ab*, as shown in FIG. 11B. As a result, the recesses 41*a* of the two caps 41 corresponding to the ports A and B communicate with the driven pump 44, and the opened-sucking operation is performed on the recess 41*a* of the open-state cap 41 corresponding to the port B, while the pre-sucking operation is performed on the recess 41*a* of the closed-state cap 41 corresponding to the port A.

The maintenance control unit waits until an elapsed time from the start of the opened-sucking operation reaches a time t1'. The time t1' is a period of time equal to or shorter than the period of time required to completely suck the maximum amount of ink storable in the recess 41*a*, which is an object of the opened-sucking operation. When ink remaining in the recess 41*a* corresponding to the port B is sucked through the opened-sucking operation, the internal pressure in each of the recesses 41*a* corresponding to the ports A and B is reduced. However, since the opened-sucking operation is stopped before the ink remaining in the recess 41*a* corresponding to the port B is completely sucked, a negative pressure is maintained in each of the recesses 41*a* corresponding to the port A and B (see FIG. 9).

Figure 11C:
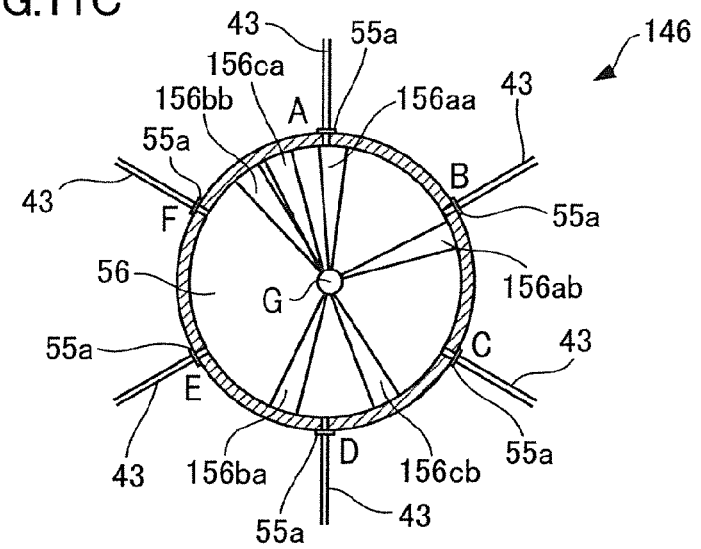

When the maintenance control unit determines that the elapsed time has reached the time t1', the maintenance control unit controls the lifting and lowering mechanism 42, to cause the caps 41 corresponding to the ports A and B to be in the closed state. Then, the maintenance control unit rotates the rotator 56 in the clockwise direction, thereby connecting the port A with the selection passage 156*aa* while closing the port B, as shown in FIG. 11C. With this, only the recess 41*a* of the closed-state cap 41 corresponding to the port A communicates with the driven pump 44, and the sucking operation is started, so that ink is discharged to the recess 41*a* from the ejection openings 8 opposed to the recess 41*a*. Here, the negative pressure created by the pre-sucking operation performed prior thereto is maintained in the recess 41*a* corresponding to the port A, and therefore the pressure therein is quickly decreased to a desired level compared with a case where the pre-sucking operation is not performed. This allows ink to be efficiently discharged from the ejection openings 8 opposed to the recess 41*a*.

When the elapsed time from the start of the sucking operation reaches the time t2, the maintenance control unit controls the lifting and lowering mechanism 42, to cause the cap 41 corresponding to the port A to transition from the closed state to the open state. This changes the operation from the sucking operation to the opened-sucking operation. At this time, only the port A corresponding the head 2 to be subjected to the opened-sucking operation communicates with the pump 44, and therefore, ink remaining in the recess 41*a* is efficiently sucked. After a predetermined period of time has passed from the start of the opened-sucking operation, the maintenance control unit stops driving the pump 44 and causes all the caps 41 to be in the open state. The above predetermined period of time is a period of time needed to complete the suction of ink remaining in the recess 41*a*. Then, the maintenance control unit 62 moves the maintenance unit 40 to the withdrawal position. Thereafter, the maintenance control unit 62 ends the routine for purging.

In this embodiment, the opened-sucking operation and the pre-sucking operation are respectively and simultaneously performed on two caps 41 corresponding to arbitrarily selected two ports (A to F). However, the present invention is not limited thereto. For example, the sucking operation may be simultaneously performed on the two caps 41 corresponding to the arbitrarily selected two ports (A to F), with the two caps 41 in the closed state, while causing only the selected two ports (A to F) to communicate with the pump 44 without causing the other ports (A to F) to communicate with the pump 44.

As described above, in this embodiment, only the recesses 41*a* of two caps 41 are connected to the pump 44 as a result of selection of the rotational position of the rotator 156, and therefore, it is possible to suck air in the recesses 41*a* of the two caps 41 at the same time. This shortens the period of time required to recover the ejection performance. Consequently, the maintenance operation is completed quickly.

The six ports A to F are arranged in the circumferential direction of the rotator 56 at equal intervals of the 60 degree central angle. This simplifies the structure of the passages. Further, the angles of the selection passage pairs 157*a* to 157*c*, each of which angles formed by the two selection passages of corresponding one selection passage pair, are angles obtained by multiplying 60 degrees (X) by n (n=1, 2, and 3), and these angles are different from each other. This further simplifies the structure of the passages.

First Modification

Figure 12:
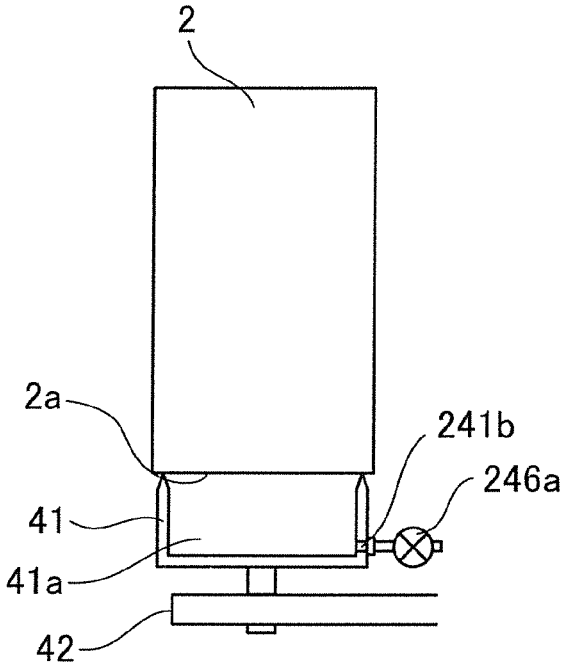
FIG. 12 is a diagram showing a first modification.

In the above embodiments, the lifting and lowering mechanism acting as the mover functions as an atmosphere communicator. Specifically, a cap 41 is brought into the closed state (an atmosphere communication closed state) when the distal end of the protrusion of the cap 41 is brought into contact with the corresponding ejection surface 2*a*, and the cap 41 is brought into the open state (an atmosphere communication established state) when the distal end is separated from the ejection surface 2*a*. However, the way of switching between the closed state and the open state is not limited to the above. For example, in a first modification shown in FIG. 12, an atmosphere communication passage 241*b* is formed in a side wall of each cap 41, the atmosphere communication passage 241*b* causing the corresponding recess 41*a* to communicate with the atmosphere. There is provided a valve 246*b* which opens/closes the atmosphere communication passage 241*b*. In the first modification, the atmosphere communicator includes the valve 246*b*, and the atmosphere communicator opens/closes the valve 246*b* with the distal end of the protrusion of the cap 41 being in contact with the corresponding ejection surface 2*a*. This achieves quick switching between the closed state and the open state. Here, it is preferable that the cross section of each atmosphere communication passage 241*b* is larger than the cross section of a passage of each suction tube 43. In this case, when the pre-sucking operation and the opened-sucking operation are simultaneously performed, a passage resistance interferes with suction in the opened-sucking operation, and therefore a negative pressure is efficiently created in the recess 44*a* of the cap 44 on which the pre-sucking operation is performed.

Second Modification

Figure 13:
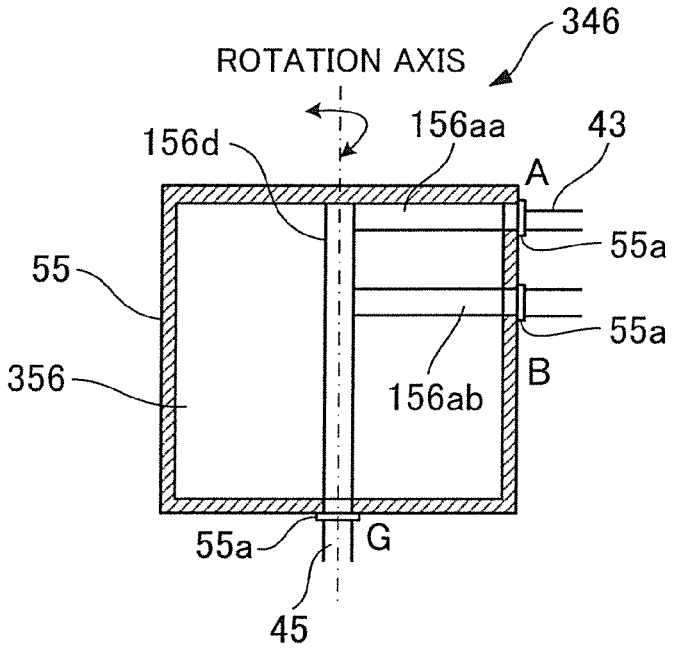
FIG. 13 is a diagram showing a second modification.

In the above embodiments, the six holes 55*a* are spaced apart from each other in the circumferential direction of the rotator 56. However, the present invention is not limited to this structure. For example, in a second modification shown in FIG. 13, two holes 55*a* are spaced apart from each other in an axial direction of a rotator 356. In other words, the two holes 55*a* are respectively disposed at positions different from each other with respect to the rotation axis of the rotator 356. The suction tube 43 includes two openings respectively connected with the two holes 55*a*. In the second modification, since there is a sufficient distance between the holes 55*a* adjacent to each other, an area for mounting a sealing member or the like is reserved easily.

Third Modification

Figure 14:
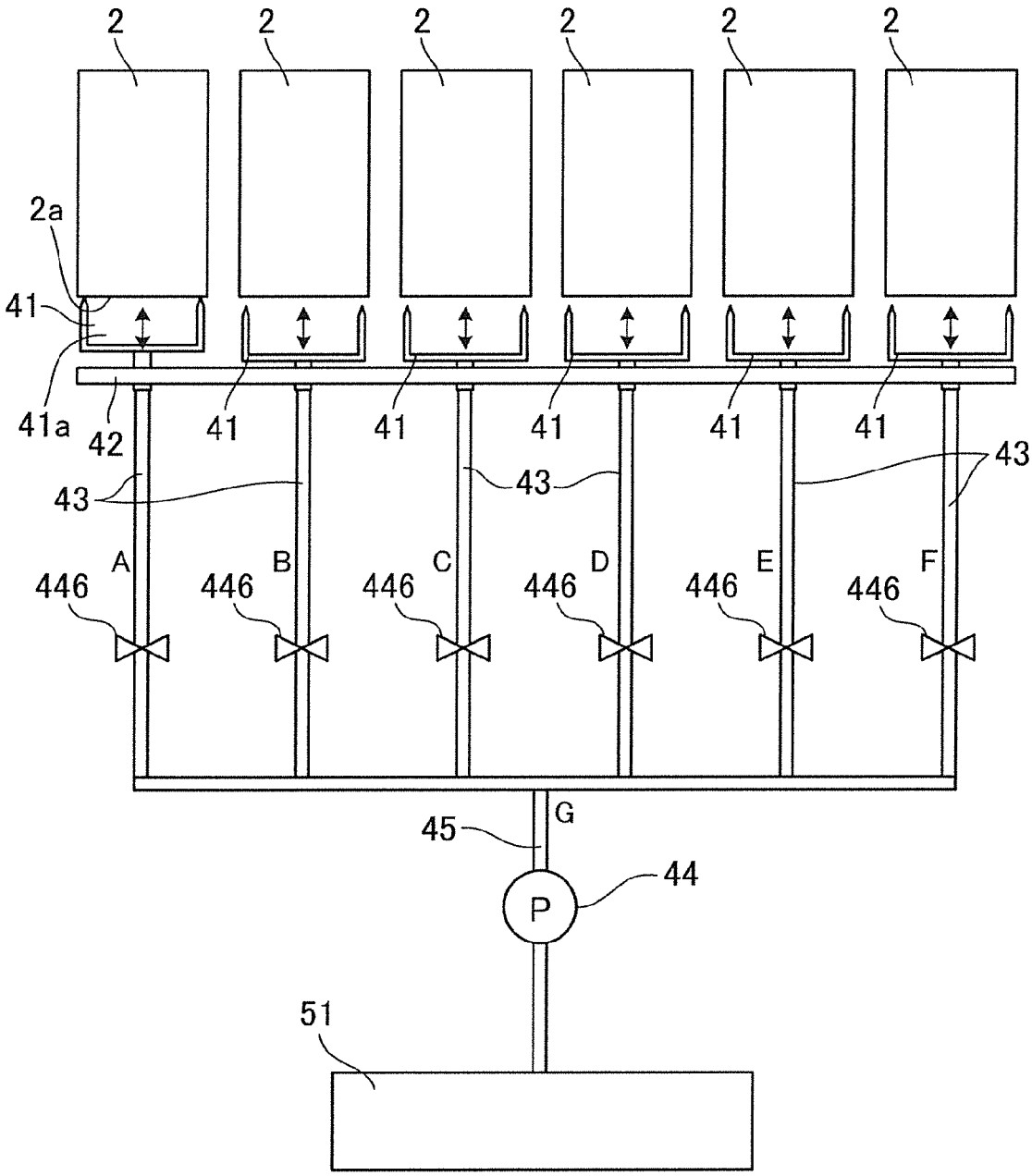
FIG. 14 is a diagram showing a third modification.

In the above embodiments, the rotary valve is described as a switcher, by way of example. However, the switcher is not limited to the rotary valve. For example, in a third modification shown in FIG. 14, instead of the rotary valve, each suction tube 43 is provided with an on-off valve 446. The on-off valves 446 are individually controlled by the maintenance control unit 62, so that the respective suction tubes 43 are individually connected with or disconnected from the pump 44 serving as the sucker.

Fourth Modification

Figure 15A:
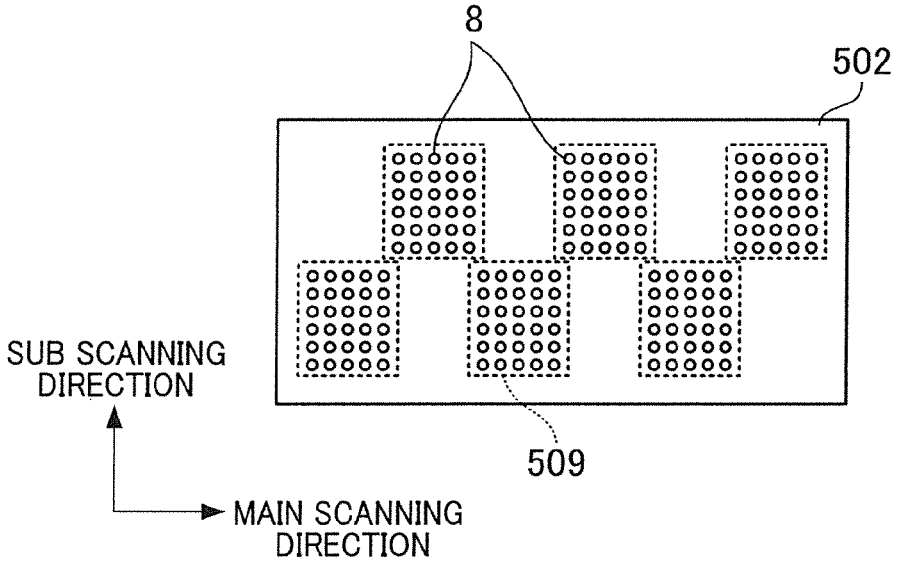
FIG. 15A is a plan view of a head of a fourth modification.
Figure 15B:
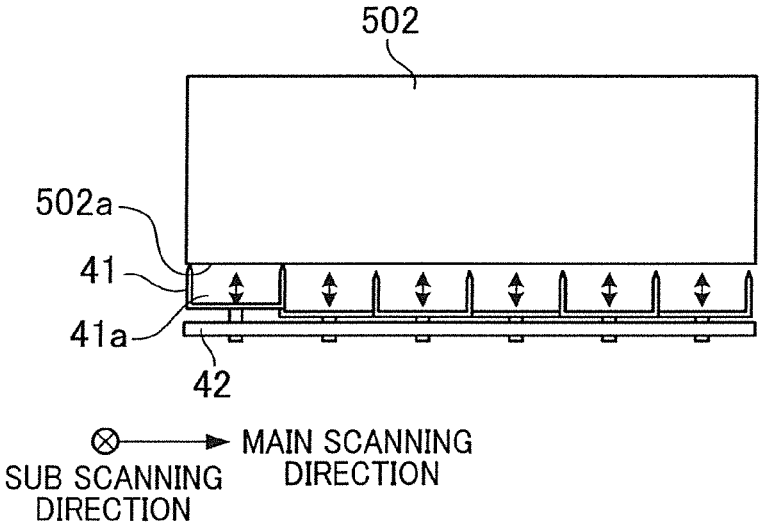
FIG. 15B is a schematic side view of the head and caps of the fourth modification.

In the above embodiments, the six heads 2 respectively eject different types of ink. However, the number of the heads does not have to match the number of the types of ink. For example, in a fourth modification shown in FIGS. 15A and 15B, a single ink jet head 502 ejects six types of ink. In the fourth modification, six ejection opening groups 509 are arranged in a longitudinal direction of the head 502. Each ejection opening group 509 includes ejection opening rows respectively corresponding to the types of ink. As shown in FIG. 15B, each cap 41 closes off, from the outside, the ejection openings 8 belonging to the corresponding ejection opening group 509. Although the caps 41 are arranged in the sub scanning direction in the above-described embodiments, they are arranged in a staggered manner in the main scanning direction in the fourth modification.

In the above embodiments, the case 55 has the cylindrical shape, and the rotator 56 has the columnar shape. However, as long as the rotator is rotatable in the internal space of the case, the shape of the case and the shape of the rotator may be arbitrarily selected. For example, it is possible to adopt a structure such that a spherical rotator is rotatable in a spherical internal space.

In the above embodiments, the caps 41 are individually brought into either the closed state or the open state. However, all the caps 41 may be brought into the closed state or the open state, at the same time. In this case, the sucking is performed on all the caps 41 at the same time.

In the above embodiments, each cap 41 regarding which air in the recess 41*a* is not sucked is always in the closed state. However, the timing at which each cap 41 is brought into the closed state may be arbitrarily determined.

The second passage of the first embodiment and each selection passage of the second embodiment are designed so that the length thereof in the circumferential direction of the rotator, that is, the width thereof increases toward the outer peripheral surface of the rotator. However, the present invention is not limited thereto. For example, the width of each of these passages may be constant.

The application of the present invention is not limited to the printer, and the present invention is applicable to facsimile machines, photocopiers, and the like. The head may eject arbitrary liquid other than ink. An object to which liquid is ejected is not limited to a sheet of paper.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus, comprising:

a head comprising a plurality of ejection opening groups, each ejection opening group comprising one or more ejection openings for ejecting liquid;

a plurality of caps which are provided respectively corresponding to the plurality of ejection opening groups, each of the caps comprising a recess for forming a closed space opposed to the one or more ejection openings belonging to the corresponding ejection opening group;

a mover configured to move each of the caps relative to the head individually, thereby causing each of the caps to be in either a closed state or an open state, in the closed state the one or more ejection openings belonging to the corresponding ejection opening group being closed off from an outside, in the open state the one or more ejection openings belonging to the corresponding ejection opening group being opened to the outside;

a plurality of suction tubes respectively connected to the recesses of the caps;

a sucker configured to suck air in the recesses of the caps;

a switcher configured to connect or disconnect the sucker with the suction tubes individually; and a controller configured to control the mover, the sucker, and the switcher, wherein the switcher comprises:

a case comprising an internal space and a plurality of holes, each of the holes causing the internal space to communicate with an outside of the case, the holes including a first hole connected to the sucker and a plurality of second holes respectively connected to the suction tubes; and a rotator accommodated in the internal space, the rotator being rotatable along an inner surface defining the internal space in the case, and wherein the rotator comprises a passage formed therein, the passage being configured to cause the first hole to communicate with two or more holes out of the plurality of second holes without causing the first hole to communicate with the second holes other than the two or more holes out of the plurality of second holes, depending on a rotational position of the rotator in the internal space.

2. The liquid ejection apparatus according to claim 1, wherein the passage is configured to cause all the second holes to communicate with the first hole at least once by changing, with rotation of the rotator, a combination of the two or more holes communicating with the first hole from one combination to another combination.

3. The liquid ejection apparatus according to claim 1, wherein the second holes comprise a plurality of pairs of second holes, each of the pairs constituted by two second holes adjacent to each other in a circumferential direction of the rotator, and wherein, in each of the pairs, the two second holes are spaced apart from each other in the circumferential direction at a same angle with respect to a rotation center of the rotator.

4. The liquid ejection apparatus according to claim 3, wherein the internal space has a cylindrical shape and the rotator has a columnar shape, and wherein all the second holes are spaced apart from each other in the circumferential direction at intervals of central angle x with respect to the rotation center.

5. The liquid ejection apparatus according to claim 4, wherein the passage comprises (i) a suction passage which communicates with the first hole and extends along a rotation axis of the rotator, and (ii) a plurality of selection passage pairs each constituted by a first selection passage and a second selection passage, the first selection passage extending from one hole out of the plurality of second holes to the suction passage depending on the rotational position of the rotator, the second selection passage extending from another hole out of the plurality of second holes to the suction passage depending on the rotational position of the rotator, wherein each angle formed by the first selection passage and the second selection passage is n times the central angle x, where n is an integral number equal to or greater than 1, wherein the selection passage pairs are configured to cause only two holes selected from the plurality of second holes to communicate with the suction passage for every combination of the two holes, and wherein the selection passage pairs are different from each other in the angle formed by the first selection passage and the second selection passage.

6. The liquid ejection apparatus according to claim 4, wherein two or more holes out of the plurality of second holes are spaced apart from each other in an axial direction of the rotator.

7. The liquid ejection apparatus according to claim 1, further comprising an atmosphere communicator configured to cause each of the caps to be in either (i) an atmosphere communication established state in which the recess communicates with an atmosphere, or (ii) an atmosphere communication closed state in which the recess is closed off from the atmosphere, wherein, when the switcher causes the first hole to communicate with the two or more holes out of the plurality of second holes, the atmosphere communicator causes the caps connected to the suction tubes connected to the two or more holes communicating with the first hole out of the plurality of caps to be in either the atmosphere communication established state or the atmosphere communication closed state.

8. The liquid ejection apparatus according to claim 7, wherein the mover functions as the atmosphere communicator, and the atmosphere communication closed state is created by bringing a distal end of a protrusion defining the recess in each of the caps into contact with an ejection surface of the head on which the one or more ejection openings are formed and the atmosphere communication established state is created by separating the distal end from the ejection surface, and wherein the atmosphere communication closed state corresponds to the closed state, and the atmosphere communication established state corresponds to the open state.

9. The liquid ejection apparatus according to claim 7, wherein an atmosphere communication passage is formed in a wall defining the recess in each of the caps, the atmosphere communication passage causing the recess to communicate with the atmosphere, and wherein the atmosphere communicator comprises a valve which opens/closes the atmosphere communication passage, and the atmosphere communication closed state is created by closing the valve with a distal end of a protrusion defining the recess in each of the caps being in contact with an ejection surface of the head on which the one or more ejection openings are formed, and the atmosphere communication established state is created by opening the valve with the distal end being in contact with the ejection surface.

10. The liquid ejection apparatus according to claim 9, wherein a cross-section of the atmosphere communication passage is larger than a cross-section of a passage of each of the suction tubes.

11. The liquid ejection apparatus according to claim 7, wherein the atmosphere communicator causes, out of the plurality of caps, one or more caps regarding which air in the recesses is not sucked by the sucker to be in the atmosphere communication closed state.

12. A liquid ejection apparatus, comprising:

a plurality of heads each comprising an ejection opening group, the ejection opening group comprising one or more ejection openings for ejecting liquid;

a plurality of caps which are provided respectively corresponding to the plurality of heads, each of the caps comprising a recess for forming a closed space opposed to the one or more ejection openings belonging to the corresponding ejection opening group;

a mover configured to move each of the caps relative to the heads individually, thereby causing each of the caps to be in either a closed state or an open state, in the closed state the one or more ejection openings belonging to the corresponding ejection opening group being closed off from an outside, in the open state the one or more ejection openings belonging to the corresponding ejection opening group being opened to the outside;

a plurality of suction tubes respectively connected to the recesses of the caps;

a sucker configured to suck air in the recesses of the caps;

a switcher configured to connect or disconnect the sucker with the suction tubes individually; and a controller configured to control the mover, the sucker, and the switcher, wherein, the switcher comprises:

a case comprising an internal space and a plurality of holes, each of the holes causing the internal space to communicate with an outside of the case, the holes including a first hole connected to the sucker and a plurality of second holes respectively connected to the suction tubes; and a rotator accommodated in the internal space, the rotator being rotatable along an inner surface defining the internal space in the case, and the rotator comprises a passage formed therein, the passage being configured to cause the first hole to communicate with two or more holes out of the plurality of second holes without causing the first hole to communicate with the second holes other than the two or more holes out of the plurality of second holes, depending on a rotational position of the rotator in the internal space.

13. A liquid ejection apparatus, comprising:

a head comprising a plurality of ejection opening groups, each ejection opening group comprising one or more ejection openings for ejecting liquid;

a plurality of caps which are provided respectively corresponding to the plurality of ejection opening groups, each of the caps comprising a recess for forming a closed space opposed to the one or more ejection openings belonging to the corresponding ejection opening group;

a mover configured to move each of the caps relative to the head individually, thereby causing each of the caps to be in either a closed state or an open state, in the closed state the one or more ejection openings belonging to the corresponding ejection opening group being closed off from an outside, in the open state the one or more ejection openings belonging to the corresponding ejection opening group being opened to the outside;

a plurality of suction tubes respectively connected to the recesses of the caps;

a sucker configured to suck air in the recesses of the caps;

a switcher configured to connect or disconnect the sucker with the suction tubes individually; and a controller configured to control the mover, the sucker, and the switcher, wherein the switcher comprises:

a case comprising an internal space and a plurality of holes, each of the holes causing the internal space to communicate with an outside of the case; and a rotator accommodated in the internal space, the rotator being rotatable along an inner surface defining the internal space in the case, wherein the suction tubes are respectively connected to the holes, wherein the rotator comprises a passage formed therein, the passage being configured to cause the sucker to communicate with two or more holes out of the plurality of holes without causing the sucker to communicate with the holes other than the two or more holes out of the plurality of holes, depending on a rotational position of the rotator in the internal space, wherein the holes comprise a plurality of pairs of holes, each of the pairs constituted by two holes adjacent to each other in a circumferential direction of the rotator, wherein, in each of the pairs, the two holes are spaced apart from each other in the circumferential direction at a same angle with respect to a rotation center of the rotator, wherein the internal space has a cylindrical shape and the rotator has a columnar shape, and wherein all the holes are spaced apart from each other in the circumferential direction at intervals of central angle x with respect to the rotation center.

14. The liquid ejection apparatus according to claim 13, wherein the passage comprises (i) a suction passage which communicates with the sucker and extends along a rotation axis of the rotator, and (ii) a plurality of selection passage pairs each constituted by a first selection passage and a second selection passage, the first selection passage extending from one hole out of the plurality of holes to the suction passage depending on the rotational position of the rotator, the second selection passage extending from another hole out of the plurality of holes to the suction passage depending on the rotational position of the rotator, wherein each angle formed by the first selection passage and the second selection passage is n times the central angle x, where n is an integral number equal to or greater than 1, wherein the selection passage pairs are configured to cause only two holes selected from the plurality of holes to communicate with the suction passage for every combination of the two holes, and wherein the selection passage pairs are different from each other in the angle formed by the first selection passage and the second selection passage.

15. The liquid ejection apparatus according to claim 13, wherein two or more holes out of the plurality of holes are spaced apart from each other in an axial direction of the rotator.

16. A liquid ejection apparatus, comprising:

a head comprising a plurality of ejection opening groups, each ejection opening group comprising one or more ejection openings for ejecting liquid;

a plurality of caps which are provided respectively corresponding to the plurality of ejection opening groups, each of the caps comprising a recess for forming a closed space opposed to the one or more ejection openings belonging to the corresponding ejection opening group;

a mover configured to move each of the caps relative to the head individually, thereby causing each of the caps to be in either a closed state or an open state, in the closed state the one or more ejection openings belonging to the corresponding ejection opening group being closed off from an outside, in the open state the one or more ejection openings belonging to the corresponding ejection opening group being opened to the outside;

a plurality of suction tubes respectively connected to the recesses of the caps;

a sucker configured to suck air in the recesses of the caps;

a switcher configured to connect or disconnect the sucker with the suction tubes individually; and a controller configured to control the mover, the sucker, and the switcher, wherein the switcher comprises:

a case comprising an internal space and a plurality of holes, each of the holes causing the internal space to communicate with an outside of the case; and a rotator accommodated in the internal space, the rotator being rotatable along an inner surface defining the internal space in the case, wherein the suction tubes are respectively connected to the holes, wherein the rotator comprises a passage formed therein, the passage being configured to cause the sucker to communicate with two or more holes out of the plurality of holes without causing the sucker to communicate with the holes other than the two or more holes out of the plurality of holes, depending on a rotational position of the rotator in the internal space, wherein the liquid ejection apparatus further comprises an atmosphere communicator configured to cause each of the caps to be in either (i) an atmosphere communication established state in which the recess communicates with an atmosphere, or (ii) an atmosphere communication closed state in which the recess is closed off from the atmosphere, and wherein, when the switcher causes the sucker to communicate with the two or more holes, the atmosphere communicator causes the caps connected to the suction tubes connected to the two or more holes communicating with the sucker out of the plurality of caps to be in either the atmosphere communication established state or the atmosphere communication closed state.

17. The liquid ejection apparatus according to claim 16, wherein the mover functions as the atmosphere communicator, and the atmosphere communication closed state is created by bringing a distal end of a protrusion defining the recess in each of the caps into contact with an ejection surface of the head on which the one or more ejection openings are formed and the atmosphere communication established state is created by separating the distal end from the ejection surface, and wherein the atmosphere communication closed state corresponds to the closed state, and the atmosphere communication established state corresponds to the open state.

18. The liquid ejection apparatus according to claim 16, wherein an atmosphere communication passage is formed in a wall defining the recess in each of the caps, the atmosphere communication passage causing the recess to communicate with the atmosphere, and wherein the atmosphere communicator comprises a valve which opens and closes the atmosphere communication passage, the atmosphere communication closed state is created by closing the valve with a distal end of a protrusion defining the recess in each of the caps being in contact with an ejection surface of the head on which the one or more ejection openings are formed, and the atmosphere communication established state is created by opening the valve with the distal end being in contact with the ejection surface.

19. The liquid ejection apparatus according to claim 18, wherein a cross-section of the atmosphere communication passage is larger than a cross-section of a passage of each of the suction tubes.

20. The liquid ejection apparatus according to claim 16, wherein the atmosphere communicator causes, out of the plurality of caps, one or more caps regarding which air in the recesses is not sucked by the sucker to be in the atmosphere communication closed state.

* * * * *